US006893117B2

(12) United States Patent
Tanaka et al.

(10) Patent No.: US 6,893,117 B2
(45) Date of Patent: May 17, 2005

(54) LAMINATED INK JET RECORDING HEAD

(75) Inventors: Yuji Tanaka, Nagano (JP); Koji Watanabe, Nagano (JP); Tomoaki Abe, Nagano (JP); Takayuki Ishii, Nagano (JP); Naomi Shirakawa, Nagano (JP); Koichi Toba, Nagano (JP); Minoru Usui, Nagano (JP); Shinri Sakai, Nagano (JP); Kohei Kitahara, Nagano (JP); Hideaki Sonehara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 162 days.

(21) Appl. No.: 10/290,334

(22) Filed: Nov. 8, 2002

(65) Prior Publication Data

US 2003/0227512 A1 Dec. 11, 2003

Related U.S. Application Data

(62) Division of application No. 08/364,261, filed on Dec. 27, 1994, now Pat. No. 6,502,929.

(30) Foreign Application Priority Data

| | | |
|---|---|---|
| Dec. 24, 1993 | (JP) | P.5-328543 |
| Jul. 5, 1994 | (JP) | P.6-153745 |
| Dec. 22, 1994 | (JP) | P.6-335874 |

(51) Int. Cl.[7] ..... B41J 2/045
(52) U.S. Cl. ..... 347/70
(58) Field of Search ..... 347/70, 68, 69, 347/71, 72, 50, 40, 41, 42, 20, 44, 47, 27, 63, 54, 65

(56) References Cited

U.S. PATENT DOCUMENTS

| | | | |
|---|---|---|---|
| 3,747,120 | A | 7/1973 | Stemme |
| 3,946,398 | A | 3/1976 | Kyser et al. |
| 4,014,029 | A | 3/1977 | Lane et al. |
| 4,528,575 | A | 7/1985 | Matsuda et al. |
| 4,680,595 | A | 7/1987 | Cruz-Uribe et al. |
| 4,695,854 | A | 9/1987 | Cruz-Uribe |
| 4,730,197 | A | 3/1988 | Raman et al. |

(Continued)

FOREIGN PATENT DOCUMENTS

| | | |
|---|---|---|
| DE | 32 08 104 A1 | 9/1983 |
| DE | 36 28 346 | 2/1988 |

(Continued)

OTHER PUBLICATIONS

Patent Abstracts of Japan, vol. 10, No. 270 (M–517), Sep. 13, 1986 & JP–A–61 092863 (Fujitsu Ltd) May 10, 1986 (Abstract).

*Primary Examiner*—Raquel Yvette Gordon
(74) *Attorney, Agent, or Firm*—Sughrue Mion, PLLC

(57) ABSTRACT

Actuator units independently dedicated to nozzles divided into a plurality of groups are fixed to a common flow path unit having the nozzles formed therein with through holes aligned with one another. Heads of various types can be formed by using the actuator units of the same design only by changing the mode of arrangement of the nozzles in accordance with the purpose.

3 Claims, 11 Drawing Sheets

U.S. PATENT DOCUMENTS

| | | | | |
|---|---|---|---|---|
| 4,766,671 | A | 8/1988 | Utsumi et al. | |
| 4,769,654 | A | 9/1988 | Tanaka et al. | |
| 4,855,752 | A | 8/1989 | Bergstedt | |
| 4,937,597 | A | 6/1990 | Yasuhara et al. | |
| 5,087,930 | A | 2/1992 | Roy et al. | |
| 5,126,615 | A | 6/1992 | Takeuchi et al. | |
| 5,128,694 | A | 7/1992 | Kanayama | |
| 5,258,774 | A | 11/1993 | Rogers | |
| 5,289,209 | A | 2/1994 | Suzuki et al. | |
| 5,359,354 | A | 10/1994 | Hiraishi et al. | |
| 5,367,324 | A | 11/1994 | Abe et al. | |
| 5,376,856 | A | 12/1994 | Takeuchi et al. | |
| 5,402,926 | A | 4/1995 | Takeuchi et al. | |
| 5,463,412 | A | 10/1995 | Matsuda | |
| 5,475,279 | A | 12/1995 | Takeuchi et al. | |
| 5,489,930 | A | 2/1996 | Anderson | |
| 5,880,756 | A | 3/1999 | Ishii et al. | |
| 6,206,501 | B1 | 3/2001 | Ishii et al. | |
| 6,270,203 | B1 * | 8/2001 | Kitahara et al. | 347/70 |
| 6,290,340 | B1 | 9/2001 | Kitahara et al. | |

FOREIGN PATENT DOCUMENTS

| | | | |
|---|---|---|---|
| EP | 0 426 473 | A2 | 5/1991 |
| EP | 0 443 628 | | 8/1991 |
| EP | 0 554 907 | A3 | 8/1993 |
| EP | 0 572 231 | A2 | 12/1993 |
| EP | 0 584 823 | A1 | 3/1994 |
| GB | 2 182 611 | A | 5/1987 |
| JP | 57-156263 | A | 9/1982 |
| JP | 58-116163 | | 7/1983 |
| JP | 60-232967 | A | 11/1985 |
| JP | 61-25851 | | 2/1986 |
| JP | 61-200239 | | 12/1986 |
| JP | 62-101455 | | 5/1987 |
| JP | 62-111758 | A | 5/1987 |
| JP | 62-213399 | | 9/1987 |
| JP | 63-149159 | | 6/1988 |
| JP | 1-105749 | | 4/1989 |
| JP | 2-24144 | | 1/1990 |
| JP | 3-128681 | | 5/1991 |
| JP | 3-150165 | | 6/1991 |
| JP | 3-211058 | A | 9/1991 |
| JP | 3-64311 | B2 | 10/1991 |
| JP | 3-293158 | | 12/1991 |
| JP | 4-355147 | | 9/1992 |
| JP | 5-147210 | A | 6/1993 |
| JP | 5-193140 | | 8/1993 |
| JP | 5-220952 | | 8/1993 |
| JP | 5-261919 | | 12/1993 |
| JP | 5-318735 | | 12/1993 |
| JP | 6-40030 | | 2/1994 |
| WO | WO 89/07752 | A1 | 8/1989 |

* cited by examiner

LAMINATED INK JET RECORDING HEAD

This is a divisional of application Ser. No. 08/364,261 filed Dec. 27, 1994, now U.S. Pat. No. 6,502,929, the disclosure of which is incorporated herein by reference.

BACKGROUND OF THE INVENTION

1. Field of the Invention

The invention relates to an ink jot recording head which is formed by laminating plate members and which is designed to form a dot on a recording sheet by splashing an ink droplet upon reception of an Input of print data.

2. Prior Art

On-demand ink jet recording heads that are designed to output characters and graphics by jetting ink droplets from a plurality of nozzles in accordance with input information are rapidly gaining in popularity because of their high print quality and low noise compared with wire-dot type recording heads and because of their low running cost compared with page printers.

Among these ink jet recording heads, a so-called face-ejected ink jet head, which is designed to jet ink droplets in a direction perpendicular to the surface of a plate by arranging a plurality of nozzles on the plate, has features that a high degree of freedom is given to nozzle arrangement and that the head can be manufactured relatively simply because of a laminated structure.

FIG. 13 shows an exemplary ink jet recording head having the aforementioned laminated structure. A channel plate 94 defining slender pressure producing chambers 96 on a flat surface has one surface thereof sealed by a vibration plate 95 having piezoelectric vibration elements 97 formed so as to correspond to pressure producing chambers 96, and the other surface thereof sealed by a regulating plate 93 having regulating orifices 98.

A manifold plate 92 laminated on the surface of the regulating plate 93 has through holes that define reservoir chambers 99 for supplying ink to the respective pressure producing chambers 96 via the regulating orifices 98. Flow paths 100, 101, 102 which supply the ink from an ink tank and which runs through the vibration plate 95, the channel plate 94, and the regulating plate 93 are formed for the reservoir chambers 99.

Further, nozzles 90 are formed in a nozzle plate 103 that is fixed to a side opposite to the vibration plate 95. Communicating holes 104, 105, 106 for connecting the nozzles 90 to the respective pressure producing chambers are formed so as to extend through the regulating plate 93, the manifold plate 92 and an additional plate 91 between the manifold plate 92 and the nozzle plate 103.

This laminated ink jet recording head is characterized in that the respective pressure producing chambers are typically arranged in two arrays so as to confront each other at an interval of from 0.04 to 0.06 inches within an array and are alternately connected to the nozzles pitched at an interval of from 0.02 to 0.03 inches within the single array.

By the way, to improve the recording quality of such ink jet recording head, it is necessary to increase the density of pixels to be recorded by downsizing an ink droplet to be jetted. Further, to ensure proper recording speed with the pixel density satisfied, It is necessary to increase the number of nozzles that jet ink droplets. Color printing, in particular, that forms a single pixel by three to four colors necessarily requires a great number of nozzles as well as a complicated flow path structure that can introduce the ink to such a great number of nozzles.

Particularly, to improve recording quality by increasing the density of pixels to be recorded, it is necessary to increase the nozzle arrangement density, which complicates the flow path structure between an ink containing section and the individual nozzles. This holds true not only for the plane dimensions and arrangement but for the thickness as well. To machine a smaller through hole in a plate in terms of the plane dimensions, it is necessary to reduce the thickness to a degree equal to the diameter of the hole.

To overcome these problems, a method of mounting a plurality of recording heads by staggering the nozzles is available. However, this method calls for an extremely high assembling accuracy in order to maintain the relative positioning accuracy among the respective recording heads.

SUMMARY OF THE INVENTION

The invention has been made in consideration of the aforementioned problems. Accordingly, an object of the invention is to provide a novel laminated ink jet recording head that can form nozzles at high accuracy by comparatively easy positioning operation.

Another object of the invention is to provide a novel laminated ink jet recording head that can be prepared inexpensively by utilizing the properties of two units, one being made of a metal material and the other being made of a ceramic material.

To achieve the above objects, the invention is applied to a laminated ink jet recording head that has a flow path unit being formed by laminating a nozzle plate, a reservoir chamber forming board, and an ink supply inlet forming board, the nozzle plate having nozzles divided into a plurality of groups, the reservoir chamber forming board having a plurality of reservoir chambers belonging to the respective groups of nozzles and having communicating holes respectively communicating with the nozzles, and the ink supply inlet forming board being fixed to a surface of the reservoir chamber forming board and having communicating holes for communicating with pressure producing chambers and nozzles. In such laminated ink jet recording head, a plurality of actuator units are fixed to the flow path unit so as to correspond to the groups of nozzles, each actuator unit including a pressure producing chamber forming board, a vibration plate, and piezoelectric vibration elements, the pressure producing chamber forming board having a plurality of pressure producing chambers defined by side walls, the vibration plate being fixed to a surface of the pressure producing chamber forming board, and the piezoelectric vibration elements being formed on a surface of the vibration plate so as to correspond to the pressure producing chambers.

The flow path unit serving also as the actuator fixing board is made of metal that is relatively easy to ensure accuracy by press working or the like, and the actuator unit is made of ceramic that can be secured by sintering, so that accuracy in forming the nozzles of the flow path unit can be fully utilized.

DETAILED DESCRIPTION OF THE PREFERRED EMBODIMENTS

Figure 1:
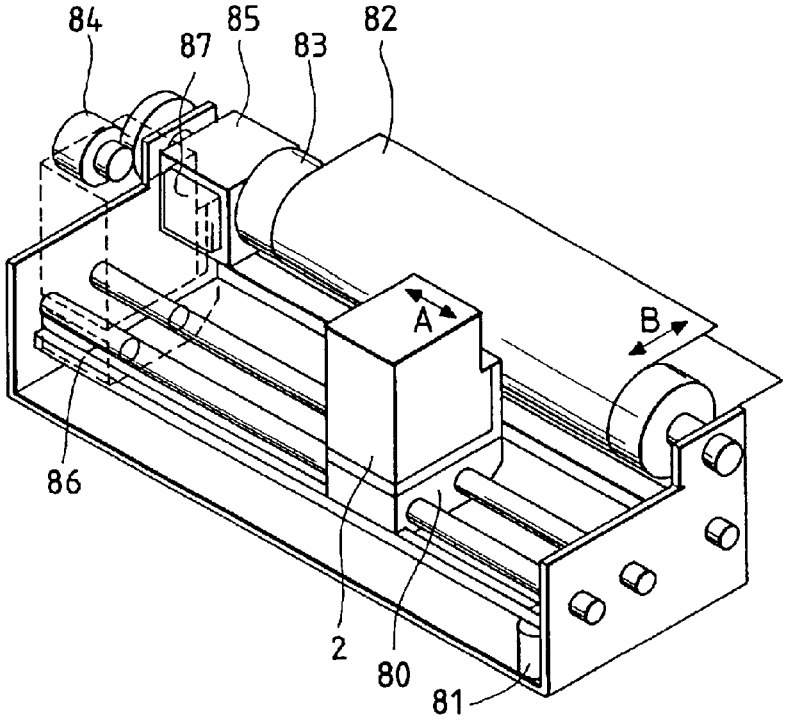
FIG. 1 is an exemplary recording apparatus to which an ink jet recording head of the invention is applied.

Details of the invention will now be described with reference to embodiments shown in the drawings.

FIG. 1 is an exemplary recording apparatus to which a laminated ink jet recording head of the invention is applied.

In FIG. 1, reference numeral 2 denotes a print mechanism section. A carriage 80 is moved in main scanning directions (in the directions indicated by arrows A in FIG. 1) by a carriage motor 81. A recording medium 82 is moved in auxiliary scanning directions (in tho directions indicated by arrows B in FIG. 1) by a sheet forward motor 84 while positioned by a platen 83.

Figure 2:
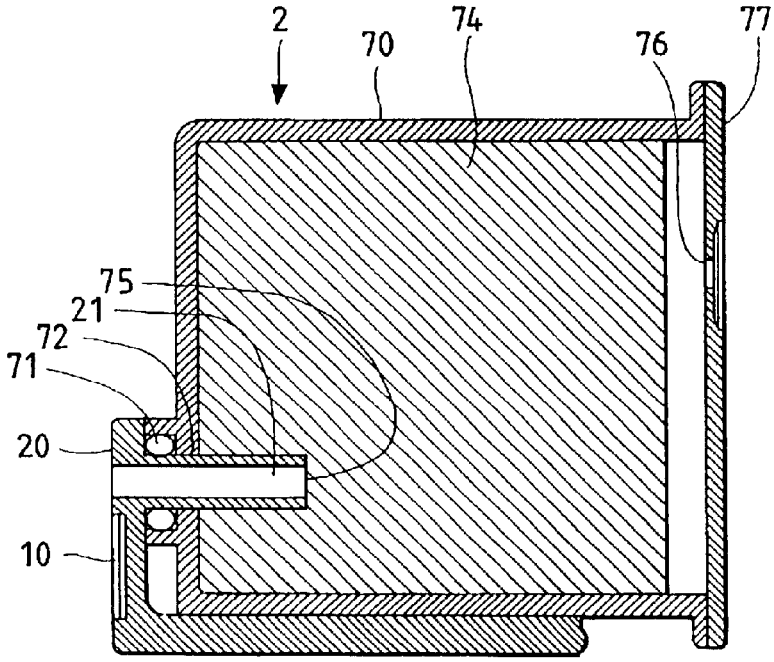
FIG. 2 is an exemplary ink jet recording head of the invention.

As shown in FIG. 2, the print mechanism section consists of an ink jet recording head 10 described later, an ink containing section 70 and a head fixing member 20 for fixing the ink jet recording head 10 and the ink containing section 70.

The ink containing section 70 contains an ink containing member 74 in the container which is secured by a lid 77 having an atmosphere communicating hole 76. Moreover, a flow path 21 is defined by an ink supply tube 72 in such a manner that one end thereof is connected to the ink jet recording head 10 and the other end thereof extends to the ink containing section 70 so as to supply the ink to the ink recording head 10. A reference numeral 71 denotes an O-ring for sealing, and a reference numeral 75 a denotes filter provided with the ink supply tube 72.

As a result of this construction, the recording head 10 forms an image on a two-dimensional plane by jetting ink droplets while moving in the main scanning directions in accordance with a print signal and having a recording medium moved in the auxiliary scanning direction every time a single line of characters or the like has been printed with ink supplied from the ink containing section 70.

In addition, when no printing is done for more than a predetermined time, the recording head 10 is evacuated to a stand-by position 86 where an ink sucking means 85 is provided. The ink sucking means 85 has a cap 87 and a not shown cap moving mechanism, and waits in a stand-by position with the cap 87 abutted against the nozzle surface of the recording head 10.

While the ink containing section is carried on the carriage 80 in the aforementioned embodiment, the ink may be supplied to the recording head 10 through a tube by arranging an ink tank on a case or the like.

Figure 3:
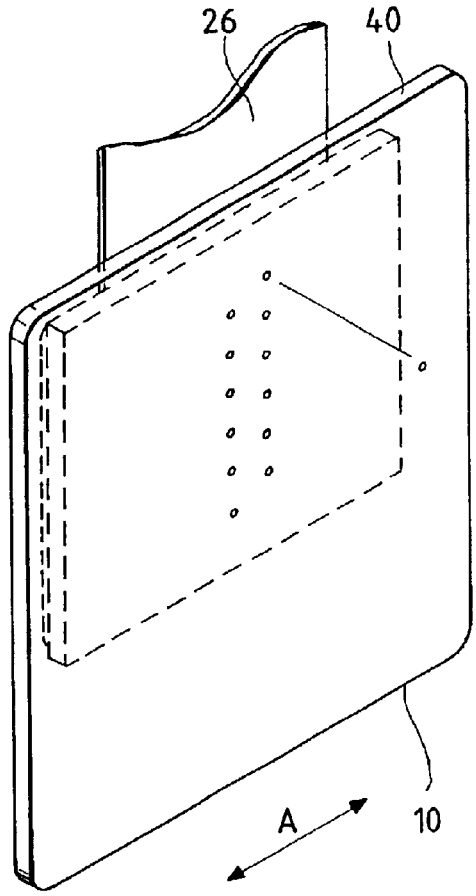
FIG. 3 is a diagram showing an ink jet recording head formed by fixing a single actuator unit to a flow path unit.
Figure 4:
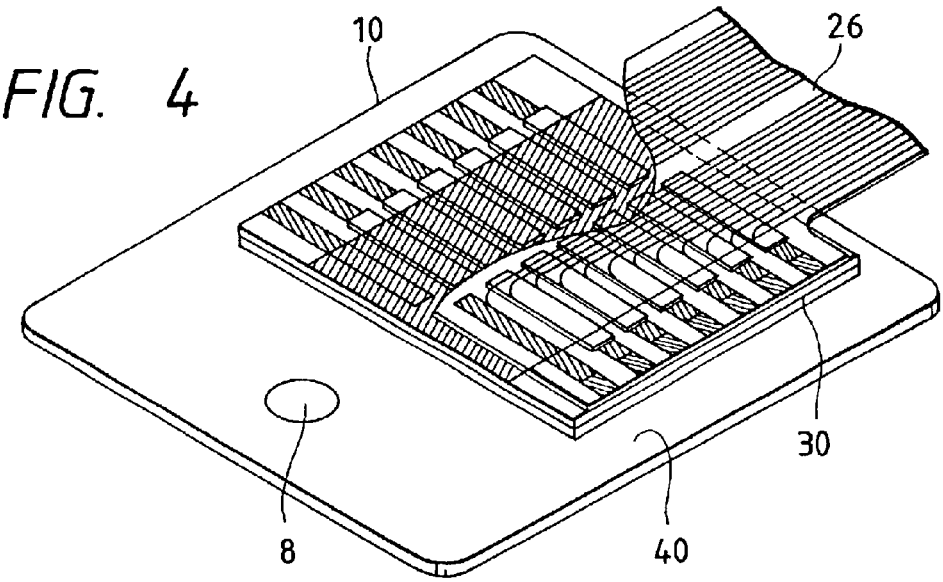
FIG. 4 is a diagram showing a structure of the recording head of FIG. 3 on the actuator unit side.

FIGS. 3 and 4 show an embodiment of the aforementioned ink jet recording head 10. The recording head 10 is formed by fixing a plate-like actuator unit 30 on a surface of a similar plate-like flow path unit 40 whose area is large enough to mount the actuator unit 30 thereon. An end of a flexible cable 26 is connected to one surface of the actuator unit 30, the flexible cable serving to apply a drive signal to a piezoelectric vibration element, which will be described later.

Figure 5:
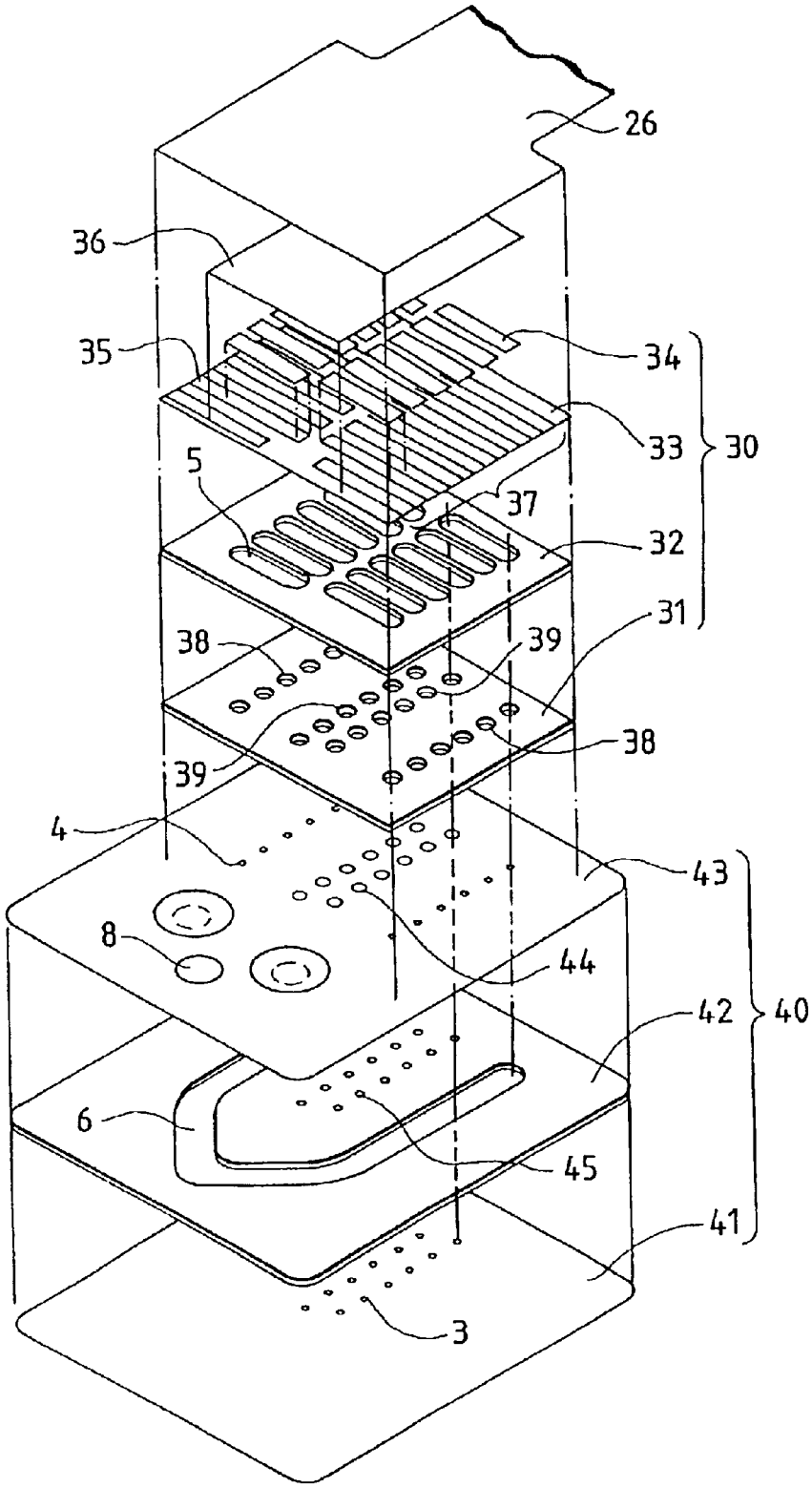
FIG. 5 is an exploded perspective view showing an internal structure of the recording head of FIG. 3.

FIG. 5 shows an embodiment of the actuator unit. The actuator unit 30 is formed by sequentially laminating a seal board 31, a pressure producing chamber forming board 32, and a vibration plate 33. Lower electrodes 35 are formed on the vibration plate 33 while separated from one another so as to correspond to respective pressure producing chambers 5. Piezoelectric vibration elements 34, each being made of an electrostrictive material, are formed 80 as to correspond to the surfaces of the lower electrodes 35 in the form of a layer. An upper electrode 36 is formed on the surfaces of the piezoelectric vibration elements 34 so that the piezoelectric vibration elements 34 are interposed between the lower electrodes 35 and the upper electrode 36 with the upper electrode 36 stretching over a plurality of piezoelectric vibration elements 34.

That is, a drive signal is applied individually to a lower electrode 35 so that a piezoelectric vibration element 34 is selectively driven. The upper electrode 36 serving as a common electrode and the lower electrodes 35 serving as individual electrodes are connected to an external drive circuit through a connection terminal 37 formed on the vibration plate 33 and a flexible printed board (FP). The respective pressure producing chambers 5 for producing pressure necessary for jetting ink droplets have arrangement thereof on a plane regulated by slender through holes formed in the pressure producing chamber forming board 32. The peripheral wall of each through hole serves as a side wall to define and separate pressure producing chambers from one another.

Further, the seal board 31 is not only bonded to the side walls so as to be airtight in order to seal the pressure producing chambers 5 and provides the bottom wall for the pressure producing chamber 5, but also has first communicating holes 38 and second communicating holes 39 formed so that both holes 36, 39 are connected to each pressure producing chamber 5 in the vicinity of both ends of the pressure producing chamber 5. Each first communicating hole 38 serves to supply the ink with the corresponding pressure producing chamber from outside the actuator unit, and each second communicating hole 39 serves to connect to a corresponding nozzle 3 that jets an ink droplet.

The flow path unit 40 is formed by sequentially laminating a nozzle plate 41, a reservoir chamber forming board 42, and an ink supply inlet forming board 43. The reservoir chamber forming board 42 has a through hole for defining a reservoir chamber 6. The reservoir chamber 6 is formed by having one end of the surface thereof sealed by the nozzle plate 41 and the other end of the surface thereof sealed by the ink supply inlet forming board 43. The reservoir chamber 6 functions as a manifold for branching the ink from the ink containing section 74 into the respective pressure producing chambers 5, and extends from a portion overlapping the respective pressure producing chambers 5 in terms of a plane to a portion not overlapping the actuator unit 30 in terms of a plane as viewed from the board surface.

In the reservoir chamber 6, ink supply inlets 4 for supplying the ink to the individual pressure producing chambers 5 from tho reservoir chamber 6 are formed in a portion of the reservoir chamber forming board 42 overlapping the respective pressure producing chambers 5 in terms of a plane, whereas a reservoir inlet 8 for introducing the ink from the ink containing section 74 to the reservoir chamber 6 is formed in a region not overlapping the actuator unit 30 in terms of a plane. In addition, the nozzle plate 41 has nozzles 3 for jetting ink droplets formed so as to correspond to the pressure producing chambers 5. To connect the nozzles 3 to the corresponding pressure producing chambers 5, nozzle communication holes 44, 45 are arranged in the ink supply inlet forming board 43 and the reservoir chamber forming board 42 so as to correspond to the nozzles 3, respectively.

The ink supply inlets 4 and the nozzle communication holes 44, which are opened onto one of the surfaces of the flow path unit 40 are formed at positions overlapping the first communicating holes 38 and the second communicating holes 39 of the actuator unit 30 to which the ink supply inlets 4 and the nozzle communication holes 44 correspond on a one-by-one basis. The flow paths between the respective units are connected to one another by bonding the actuator unit 30 to the flow path unit 40 with the corresponding openings thereof overlapping upon one another.

Flow of the ink within the head unit 10 formed of the flow path unit 40 and the actuator unit 30 will be described with reference to FIG. 6, which shows a structure in section taken along a slender pressure producing chamber.

Figure 6:
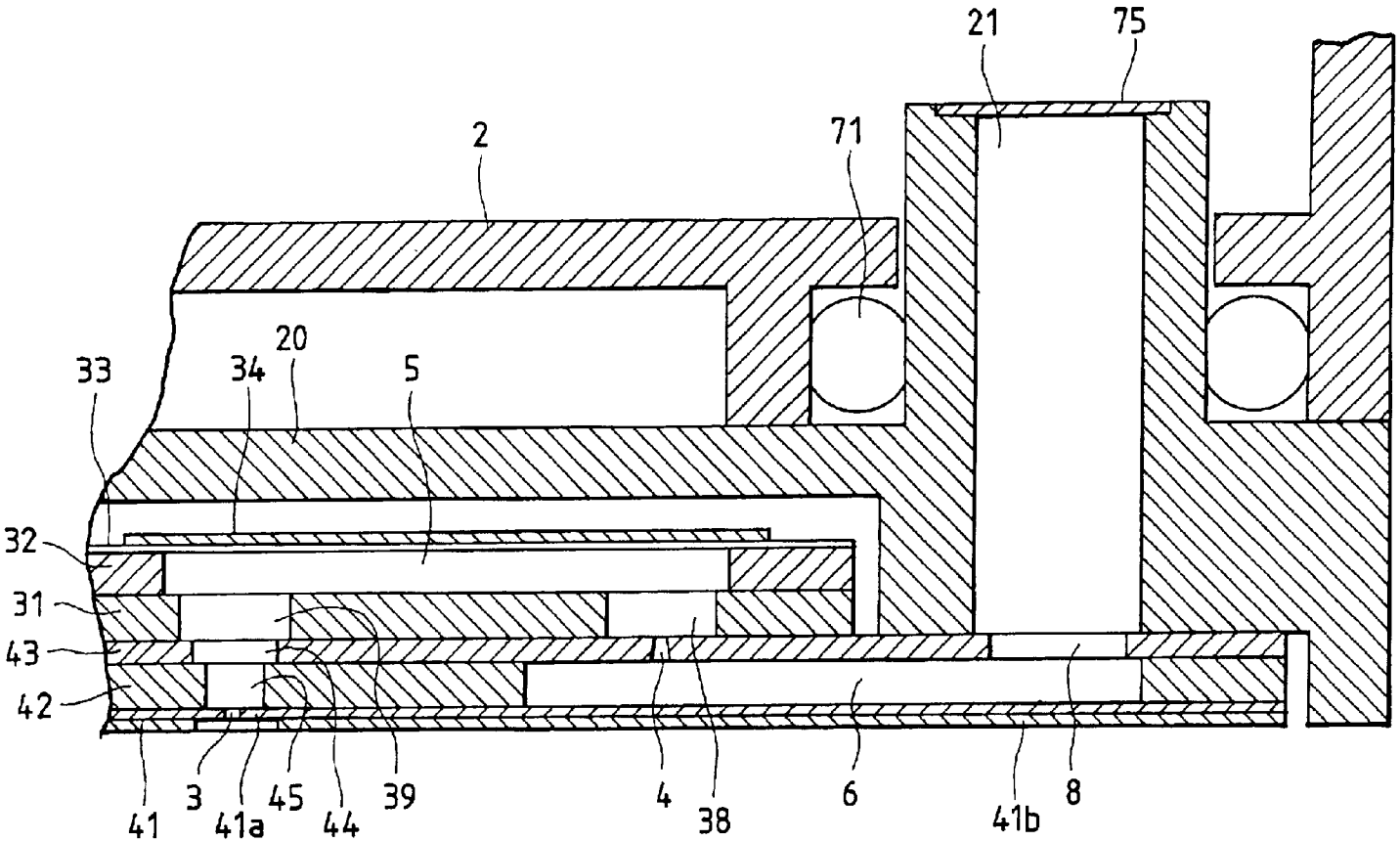
FIG. 6 is a diagram showing a structure in section of the recording head of FIG. 3.

FIG. 6 shows the reservoir inlet 8 arranged in the same section as the pressure producing chamber 5 for simplification of the description. The ink introduced from the ink containing section is supplied to the pressure producing chamber 5 via the reservoir inlet 8, the reservoir chamber 6, the ink supply inlet 4, and the communicating hole 38. The ink supply inlet is designed so that when the ink is initially charged into the flow path, or when bubbles are produced within the flow path, or when the viscosity of the ink is increased, the ink or bubbles are forcibly sucked from the nozzle 3 and discharged using the ink sucking means 85.

Further, at the time of printing, a capillary force derived from a meniscus formed in the nozzle 3 causes the ink to flow into the pressure producing chamber 5 from the ink containing section. The piezoelectric vibration element 34 constitutes an unimorph vibration element together with the vibration plate 33. The piezoelectric vibration element 34 is contracted toward the surface by the application of a voltage thereto. The vibration plate 33 flexes in such a direction as to contract the pressure producing chamber 5, thus producing pressure in the pressure producing chamber 5. From this pressure, an ink stream is produced, the ink stream extending from the pressure producing chamber 5 to the nozzle 3 via the second communicating holes 39 and the nozzle communication holes 44, 45, and this ink stream is jetted from the nozzle 3 in the form of an ink droplet.

By the way, the nozzle plate 41 has a two-layered structure with a thin wall portion 41*a* and a thick wall portion 41*b*. The thin wall portion 41*a* exists only in the vicinity of the communicating hole 45 that is connected to the nozzle 3.

This nozzle plate 41 is formed by forming the nozzle 3 by press-working a metal plate that is resiliently deformable by the ink pressure from the pressure producing chamber 5, and thereafter plating a region excluding the vicinity of the nozzle 3 by chromium or the like to such a thickness as to ensure proper strength to thereby form the thick wall portion 41*b*.

Because the nozzle plate 41 has the thin wall portion 41*a* only in the vicinity of the nozzle 3 and the thick wall portion 41*b* in the other region, the thin wall portion 41*a* in the vicinity of the communicating hole 45 is resiliently deformed in response to the pressure derived from the pressure producing chamber 5. This not only ensures compliance necessary for jetting an ink droplet, but also contributes to increasing rigidity of a recording head to thereby minimize flexion thereof in the case where the recording head has a plurality of actuator units fixed thereto, which recording head will be described later. Since the nozzle 3 is positioned one stage below, contact of the thin wall portion 41*a* with a recording sheet or the like can also be prevented.

This embodiment is characterized as having two arrays of pressure producing chambers 5 formed so as to confront a single actuator unit 30. The pressure producing chambers 5 in one array are staggered with respect to those in the other array along the length of each array by a distance half the distance between the adjacent pressure producing chambers 5 in a single array. Further, the corresponding nozzles 3 are similarly arranged in two arrays so that the nozzles 3 in one array are staggered with respect to those in the other array by a distance half the distance between the adjacent nozzles 3 in a single array. Therefore, the distance between the adjacent nozzles 3 as viewed in the main scanning directions A is equal to a distance half the distance between the adjacent pressure producing chambers, thereby making the nozzle 3 arrangement density substantially twice.

Although only one or three or more arrays of pressure producing chambers may be arranged in a single actuator unit 30, the two-array design allows feeder lines to be arranged in spaces on both sides of the actuator unit 30, which in turn contributes to simplifying the wiring structure.

Further, while the ink is supplied to the two arrays of pressure producing chambers,through the V-shaped or U-shaped common reservoir chamber 6 in the aforementioned embodiment, reservoir chambers dedicated to the respective arrays of pressure producing chambers may be arranged to allow ink droplets of different colors to be jetted from the respective nozzle arrays.

Specific embodiments of the aforementioned flow path unit 40 will be described next.

Nozzles 3, each being a tapered hole whose opening diameter ranges from 30 to 50 $\mu$m, are arranged in two arrays at an inter-array interval of 564 $\mu$m on the nozzle plate 41 made of a stainless steel plate whose thickness ranges from 50 to 150 $\mu$m. The reservoir chamber forming board 42 has a through hole for defining the reservoir chamber 6 and the nozzle communication holes 45 formed by press working a 150 $\mu$m-thick stainless steel plate.

The diameter of the nozzle communication hole 45 is preferably set to 150 $\mu$m similarly to the thickness of the plate. The ink supply inlet forming board 43 has both the ink supply inlets 4 and the nozzle communication holes 44 formed by press working a stainless steel plate whose thickness ranges from 50 to 150 $\mu$m. The fluid impedance of the ink supply hole 4 is preferably set to a value equal to or greater than the fluid impedance of the nozzle so that an ink stream produced by the pressure of the pressure producing chamber 5 is directed toward the nozzle 3 by checking the ink stream from going toward the reservoir chamber 6.

In this embodiment, the ink supply inlet 4 is set to the same dimensions as the nozzle 3, and the section thereof is tapered toward the first communicating hole 38. Because of the taper, the diameter of the narrowest portion of the ink supply inlet 4 can be made smaller than the thickness of the plate, and in addition the ink supply inlet 4 can be formed accurately. The diameter of the nozzle communication hole 44 is larger than that of the nozzle communication hole 45 of the reservoir chamber forming board 43 and smaller than the width of the pressure producing chamber 5, ranging from 200 to 300 μm. As a result of this design, the flow path from the pressure producing chamber 5 to the nozzle 3 can be gradually narrowed, thereby preventing bubbles from stagnating along the flow path.

The three plates constituting the flow path unit are laminated so that the through holes related to one another can communicate with one another. These plates may be brazed, subjected to diffused junction, or bonded with an adhesive or a blanked adhesive sheet, or the like. In this embodiment, these plates are bonded with an adhesive made from an epoxy resin that is not corroded by ink.

While each plate is made of a stainless steel plate in this embodiment, a material of which each plate is made may be appropriately selected and combined in accordance with the function of the plate from inorganic materials such as ceramic, silicon and glass, metals such as nickel, or plastic materials such as polyimide, polycarbonate, and polysulfone as long as such materials are not corroded by ink.

The plastic plates may be subjected to excimer laser machining, or electroplating using nickel because the nozzle plate 41 and the ink supply inlet forming board 43 are comparatively thin, have holes whose diameters are small, and require high accuracy.

In this invention, the flow path unit 40, serving also as the actuator unit 30 fixing board, requires high rigidity. Therefore, a metal having both toughness and rigidity is preferred to make the flow path unit 40. Since the reservoir chamber forming board 42, in particular, has the through hole whose size is larger than those formed in the other plates, the use of a plate thicker than the other plates is preferred to provide a structure that can ensure proper rigidity.

A specific embodiment of the actuator unit 3 will be described next. The pressure producing chamber forming board 32 is a 150 μm-thick sintered body of zirconia, and has a plurality of pressure producing chambers 5 arranged in two arrays at an inter-array interval of 564 μm similarly to the nozzles 3. The width of each pressure producing chamber 5 ranges from 350 to 450 μm, and the length thereof ranges from 1 to 3 mm. These dimensions are set to optimal values in function of the magnitude of an ink droplet required for forming a dot, the nozzle arrangement density, and the like.

The seal board 31 is a 150 μm-thick sintered body of zirconia, and is bonded to one surface of the pressure producing chamber forming board 32 so as to seal one surface of each pressure producing chamber 5. The diameter of each of a pair of communicating holes 38, 39 is set to 300 μm. The vibration plate 33 is a sintered body of zirconia whose thickness ranged from 10 to 20 μm, and is bonded so as to seal the other surface of each pressure producing chamber 5. The lower electrodes 35 are formed on the vibration plate 33 so as to correspond to the pressure producing chambers 5, and on the surfaces of the lower electrodes 35 are the piezoelectric vibration elements 34. Each piezoelectric vibration element 34 is formed by laminating a piezoelectric ceramic material such as lead titanate zirconate on the corresponding lower electrode 35. The width of the piezoelectric vibration element 34 is set to values ranging from 80 to 90% of the width of the pressure producing chamber 5, and the thickness thereof ranges from 20 to 40 μm. It should be noted that other ceramic materials such as alumina, aluminum nitride, lead titanate zirconate may replace zirconia.

A method of preparing the aforementioned actuator unit will be described next.

Figure 7A:
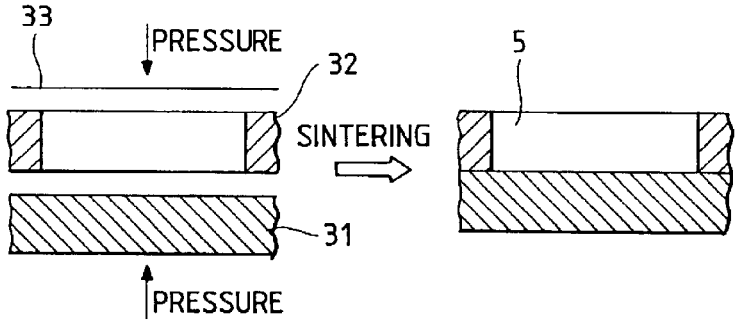
FIGS. 7(A) to (C) are diagrams showing a method of preparing an actuator unit used in the recording head of the invention.

As shown in FIG. 7(A), the vibration plate 33, the pressure producing chamber forming board 32 having the through holes for defining the pressure producing chambers 5 already punched out, and the seal board 31 having the communicating holes already punched out are bonded to one another by pressure in the form of a green sheet, i.e., in clay-like form, and the thus bonded boards are thereafter integrally wintered at temperatures ranging from 800 to 1000° C. As a result of this method, the respective boards are bonded together without an adhesive.

Figure 7B:
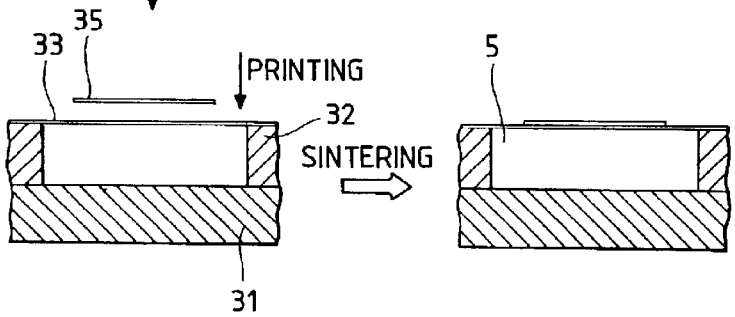

Then, as shown in FIG. 7(B), an electrode pattern is prepared by printing a material so that portions corresponding to the pressure producing chambers 5 will become the lower electrodes 35, the material having as a main component thereof at least one kind of alloys composed of platinum, palladium, silver-palladium, silver-platinum, and platinum-palladium.

Figure 7C:
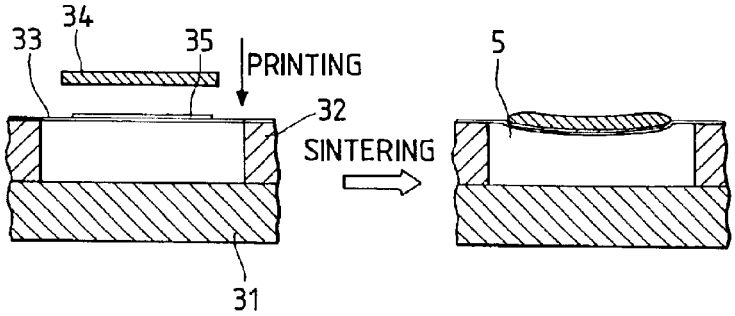

Thereafter, as shown in FIG. 7(C), the piezoelectric members 34 are laminated on the lower electrodes Similarly by printing and sintered to complete the actuator unit. Finally, a common electrode made of chromium, gold, nickel, or the like is formed by sputtering so as to stretch over a plurality of piezoelectric vibration elements.

The integrally sintered actuator unit 30 has the extremely minutely structured pressure producing chamber forming board 32 and the thin vibration plate 33 bonded together rigidly thereto. Therefore, excellent airtightness and corrosion resistance against ink are exhibited. In addition, the method of preparing the actuator unit 30, involving such simple steps of laminating the clay boards, applying the paste-like electrode and piezoelectric vibration element materials by printing, and sintering all these members, allows the actuator unit 30 to be manufactured extremely easily as well as accurately.

Although the aforementioned method of forming the actuator unit 30 characterized as integrally sintering the materials is quite excellent, the actuator unit may be formed by combining such conventional methods as a method of bonding boards made of metal or resin by adhesion, deposition, or fusion, a method of etching glass or silicon boards, a plastic molding method, and a method of mounting piezoelectric vibration element chips on the vibration plate.

While the ink stream from the pressure producing chamber 5 to the reservoir chamber 6 is regulated by the ink supply inlet 4 arranged in the flow path unit 40 in the aforementioned embodiment, the first communicating hole 38 formed in the actuator unit 30 may be constricted to such a size as to regulate return of the ink.

Further, the ink jet recording head 10 of the invention is characterized not only as setting the heat capacity of the actuator unit 30 (determined by the product of the material density, the specific heat, and the volume) to a value smaller than the heat capacity of the flow path unit 40, but also as fixing the ink jet recording head 10 to the head fixing member 20 so that the actuator unit 30 can communicate with the atmosphere.

As a result of this construction, problems such as expansion of the pressure producing chamber 5 due to freezing of the ink from the nozzle plate 41 side of the flow path unit 40 caused when the recording head is placed in a low temperature environment, and breakage of the vibration plate 33 due to such freezing can be overcome, which allows the ink to start freezing on the actuator unit side, and hence allows pressure produced within the flow path due to freezing to be released to the flow path unit side (to the atmosphere through the nozzles).

Figure 8:
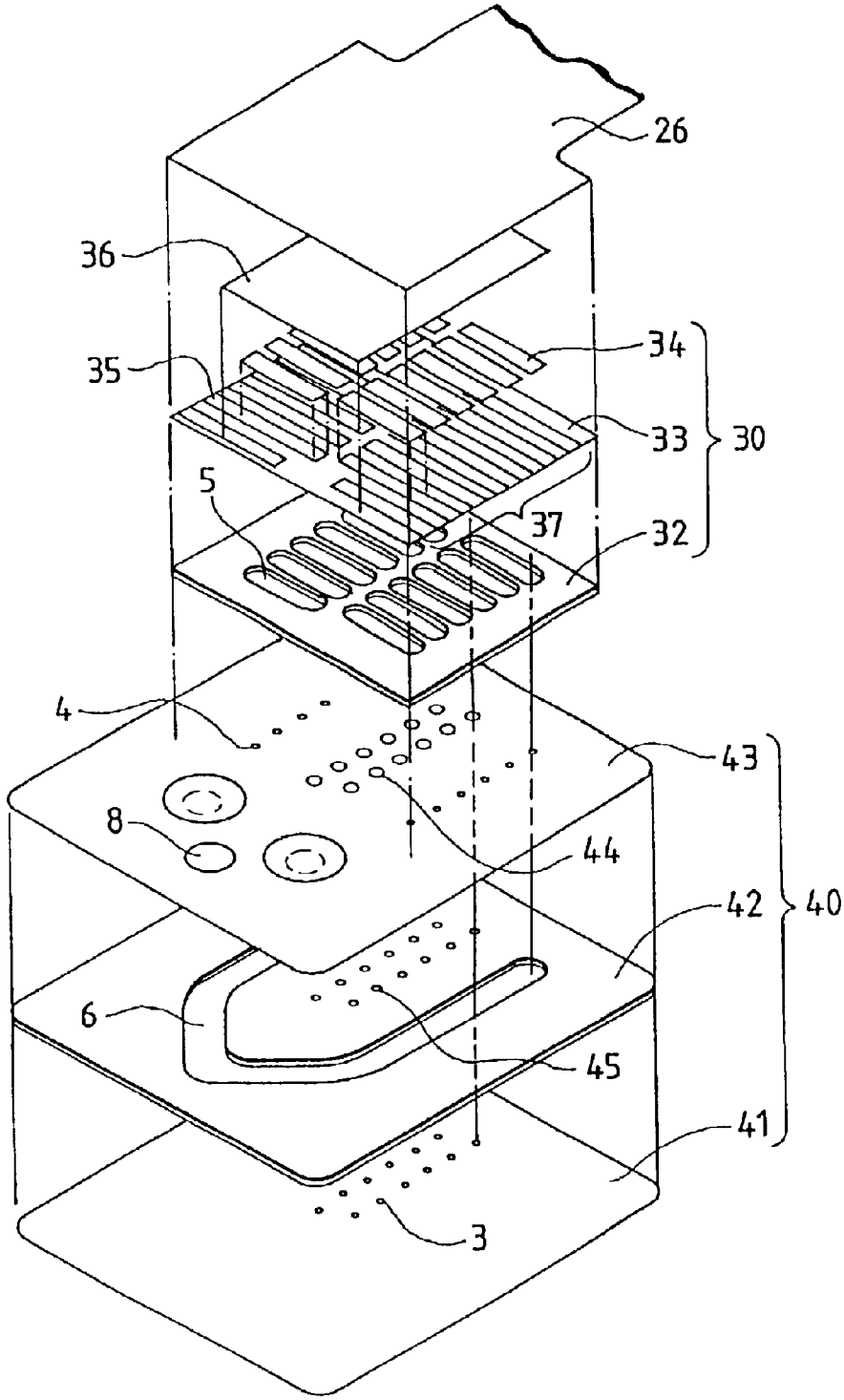
FIG. 8 is a diagram showing another embodiment of the recording head of FIG. 3.

FIG. 8 shows another embodiment of the actuator unit 30, which 18 characterized as having the openings of the pressure producing chambers 5 onto one surface of the actuator unit 30 without arranging the aforementioned seal board 31 and sealing the openings instead by the ink supply inlet forming board 43 of the flow path unit 40. This embodiment is advantageous in curtailing the number of parts involved, which in turn contributes to reducing the cost of manufacture.

Techniques for constructing various recording heads using a plurality of the aforementioned actuator units 30 will be described next with reference to FIGS. 9 and 10.

Figure 9:
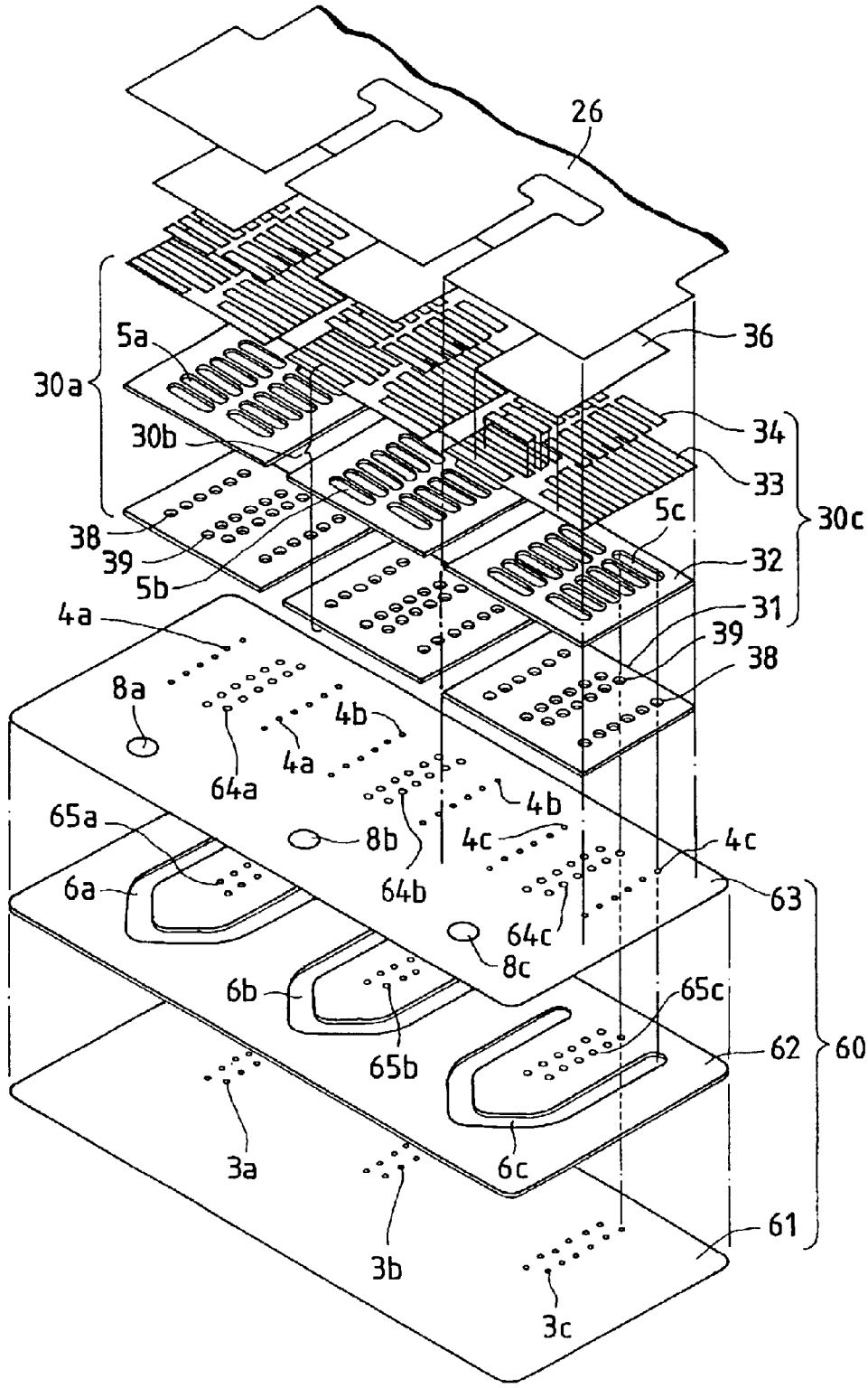
FIG. 9 is an exploded perspective view showing an ink jet recording head, which is an embodiment of the invention.
Figure 10:
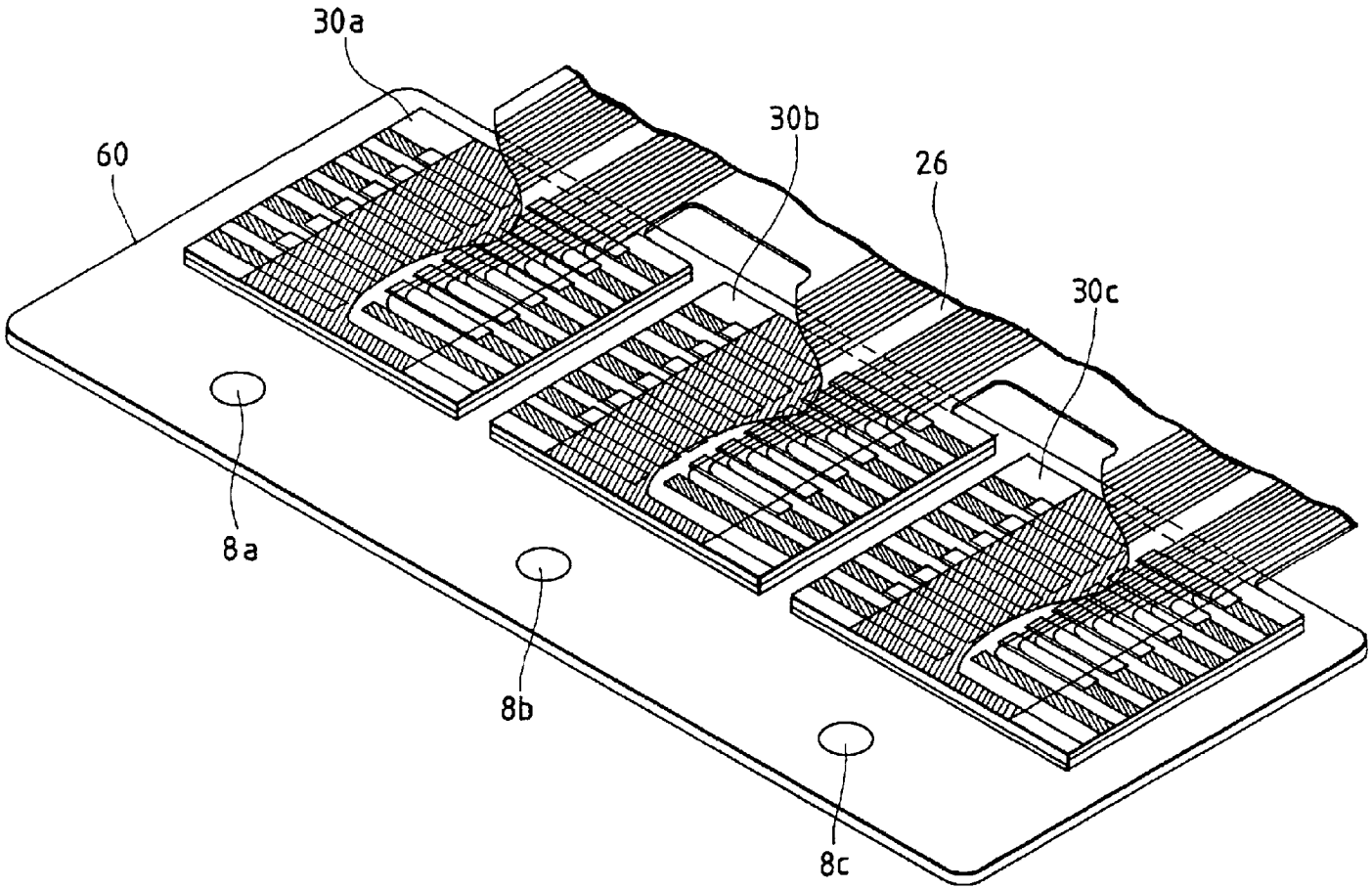
FIG. 10 is a diagram showing the ink jet recording head of the invention in the form of a structure of a side on which actuator units are mounted.

In FIGS. 9, 10, reference numeral 60 denotes a flow path unit, which is formed by laminating a nozzle plate 61, a reservoir chamber forming board 62, and an ink supply inlet forming board 63. These plate and boards 61, 62, 63 are made of metal plates, each having such a size as to allow nozzle groups 3*a*, 3*b*, 3*c* to be arranged so that at least three actuator units 30*a*, 30*b*, 30*c* do not overlap one another, each nozzle group having two arrays of nozzles.

The nozzle plate 61 has not only the nozzle groups 3*a*, 3*b*, 3*c* formed in a metal plate, each nozzle group having nozzles 3, but also a thin wall portion 41*a* in the vicinity of each nozzle 3 as shown in FIG. 6 in order to ensure compliance.

The reservoir chamber forming board 62 has through holes defining reservoir chambers 6*a*, 6*b*, 6*c* and nozzle communicating holes 65*a*, 65*b*, 65*c* which serve the same purpose as the nozzle communicating holes 45 in FIGS. 5 and 8. The reservoir chambers 6*a*, 6*b*, 6*c* are formed by sealing one surface of each through hole by the nozzle plate 61 and the other surface thereof by the ink supply inlet forming board 63. The reservoir chamber forming board 62 functions as a manifold for branching ink from the ink containing section 74 to respective pressure producing chambers 5*a*, 5*b*, 5*c*.

Ink supply inlets 4*a*, 4*b*, 4*c* for supplying the ink to the pressure producing chambers 5*a*, 5*b*, 5*c* of the respective actuator units 30*a*, 30*b*, 30*c* from the reservoir chambers 6*a*, 6*b*, 6*c* are formed in regions of the ink flow path forming board 63 overlapping the pressure producing chambers 5*a*, 5*b*, 5*c* in terms of a plane, respectively. Reservoir inlets 8*a*, 8*b*, 8*c* for introducing the ink into the ink containing section 74 are formed at regions of the ink flow path forming board 63 not overlapping the actuator units 30*a*, 30*b*, 30*c*, respectively.

Ink supply inlets 4*a*, 4*b*, 4*c* and nozzle communication holes 64*a*, 64*b*, 64*c* opening onto one surface of the flow path unit 60 are formed at positions overlapping the first communicating holes 38 and the second communicating holes 39 of the actuator units 30*a*, 30*b*, 30*c* corresponding to the inlets and holes on a one-to-one basis. By bonding the actuator units 30*a*, 30*b*, 30*c* to the flow path unit 60 so that the corresponding openings can be aligned with one another, the flow paths of tho three actuator units 30*a*, 30*b*, 30*c* can be connected to the single flow path unit 60.

As described above, the flow path unit 60 has the reservoir chambers 6*a*, 6*b*, 6*c* independently dedicated to the respective actuator units and the reservoir inlets 8*a*, 8*b*, 8*c* independently corresponding to the respective reservoir chambers 6*a*, 6*b*, 6*c*. Therefore, inks of different colors, e.g., cyan, magenta, yellow, in the respective nozzle groups 3*a*, 3*b*, 3*c* can be supplied to a single head in order to jet ink droplets of different colors from the single flow path unit.

Further, the flow path unit 60 is advantageous in that the flow path unit 60 can not only form nozzle openings at high accuracy by press working, which is a simple working method, but also use metal whose rigidity is comparatively high as a main material. On the other hand, the actuator units 30*a*, 30*b*, 30*c* can be fixed by sintering, and in addition are made of ceramic that is easy to warp or undulate at the time of sintering with increasing voltage applied thereto although the ceramic is basically electrically insulating.

As a result, a downsized recording head having nozzles arranged at high density with high accuracy can be fabricated at high yield by not only downsizing the actuator units 30*a*, 30*b*, 30*c* to a possible extent in order to increase the yield of fabrication, but also bonding such actuator units to the common flow path unit 60 having the nozzles formed with high positioning accuracy.

In addition, since the piezoelectric vibration element 34 to which a drive signal is applied can be formed on the vibration plate 33 made of ceramic that is basically electrically insulating, no special insulating process for the formation of electrodes is necessary any longer.

Figure 11:
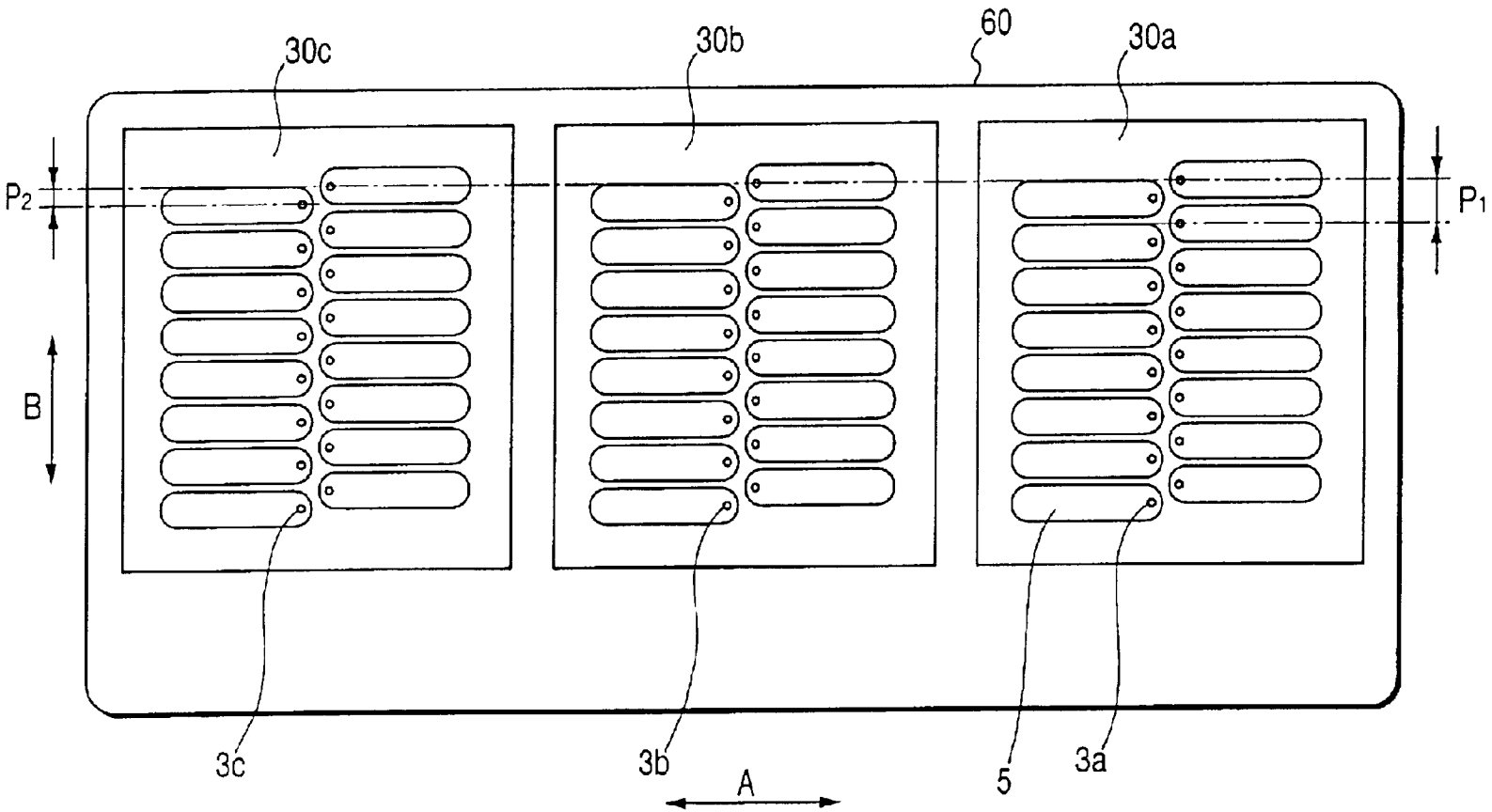
FIG. 11 is a diagram showing an ink jet recording head, which is another embodiment of the invention, in the form of an arrangement of pressure producing chambers and nozzles.

FIG. 11 shows an embodiment in terms of the relative positions between the nozzles 3 and the pressure producing chambers 5, the embodiment being characterized as forming dots by causing the actuator units 30*a*, 30*b*, 30*c* to correspond to the colors, cyan, magenta, and yellow.

This recording head has the nozzles of different colors arranged at the same positions in the auxiliary scanning direction B so that the nozzles of the respective colors can produce an ink image at the same positions. Taking a look at a single color, two arrays of pressure producing chambers, which are pitched at an interval of P1 confront each other, with one array being staggered with respect to the other by an interval of P2, which is a half of the interval P1, in the auxiliary scanning direction. As a result of this arrangement, the nozzle density in the auxiliary scanning direction is substantially set to P2.

Since the property of an ink is generally different from that of another, it is difficult to produce the best image by giving the same design to the flow paths for the respective inks. However, the ink jet recording head of the invention is characterised as producing the best image only by adjusting both the shape of each nozzle 3 of the flow path unit 60 and the shape of each of the ink supply inlets 4*a*, 4*b*, 4*c* optimally per ink even if all the actuator units are of the same design. As a result, it is actuator units of the same design that are required to be fabricated, which in turn contributes to a cost reduction brought about by mass production.

Further, since an ink jet recording head capable of jetting ink droplets in differing amounts from the respective nozzle groups 3*a*, 3*b*, 3*c* can be formed only by changing the shape of each nozzle 3 or the shape of each ink supply inlet 4 of the flow path unit 60, the ink jet recording head characterized as smoothly changing the density can be provided even if the actuator units of the same design are used.

Figure 12:
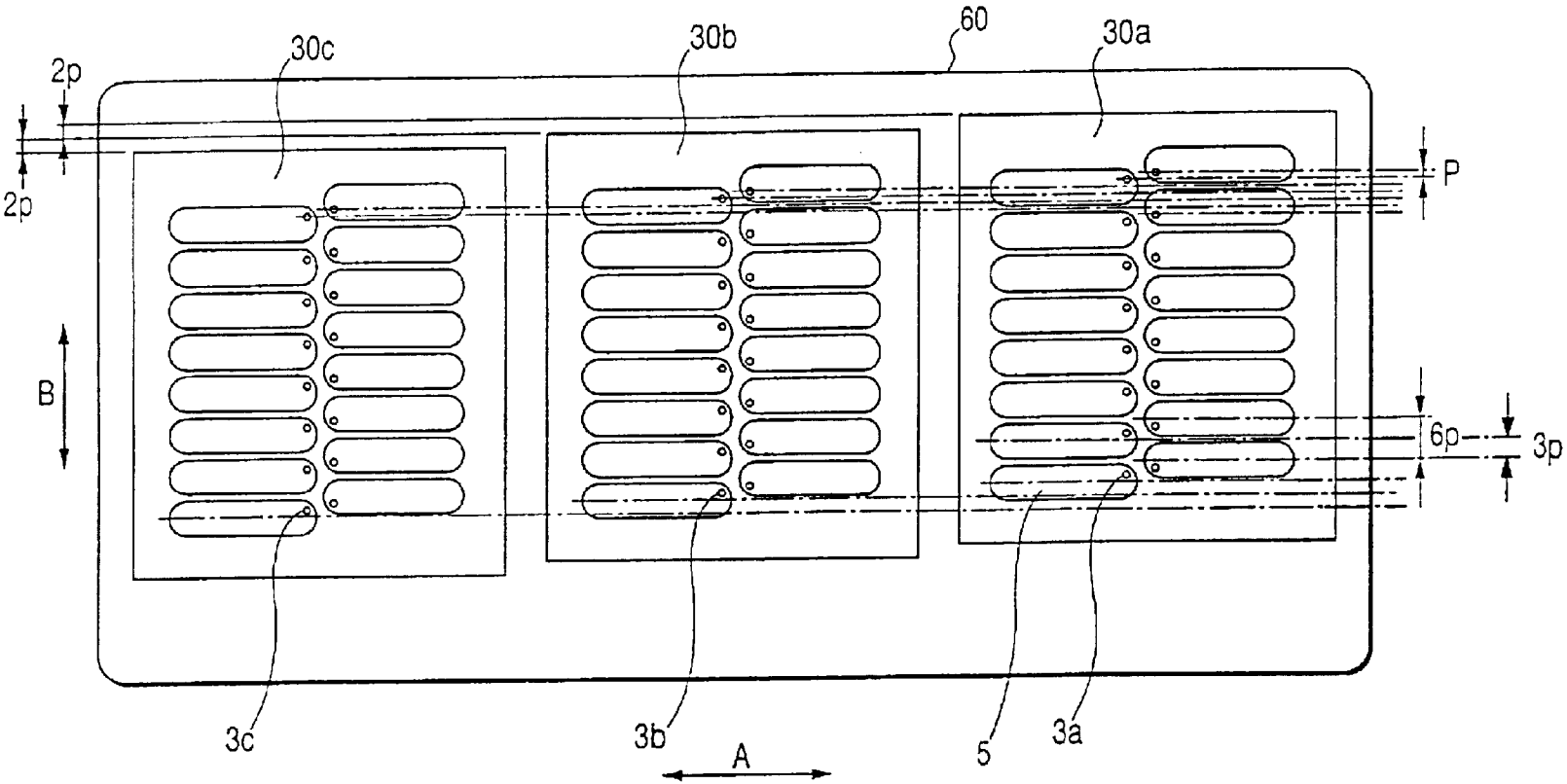
FIG. 12 is a diagram showing an ink jet recording head, which is another embodiment of the invention, in the form of an arrangement of pressure producing chambers and nozzles.
Figure 13:
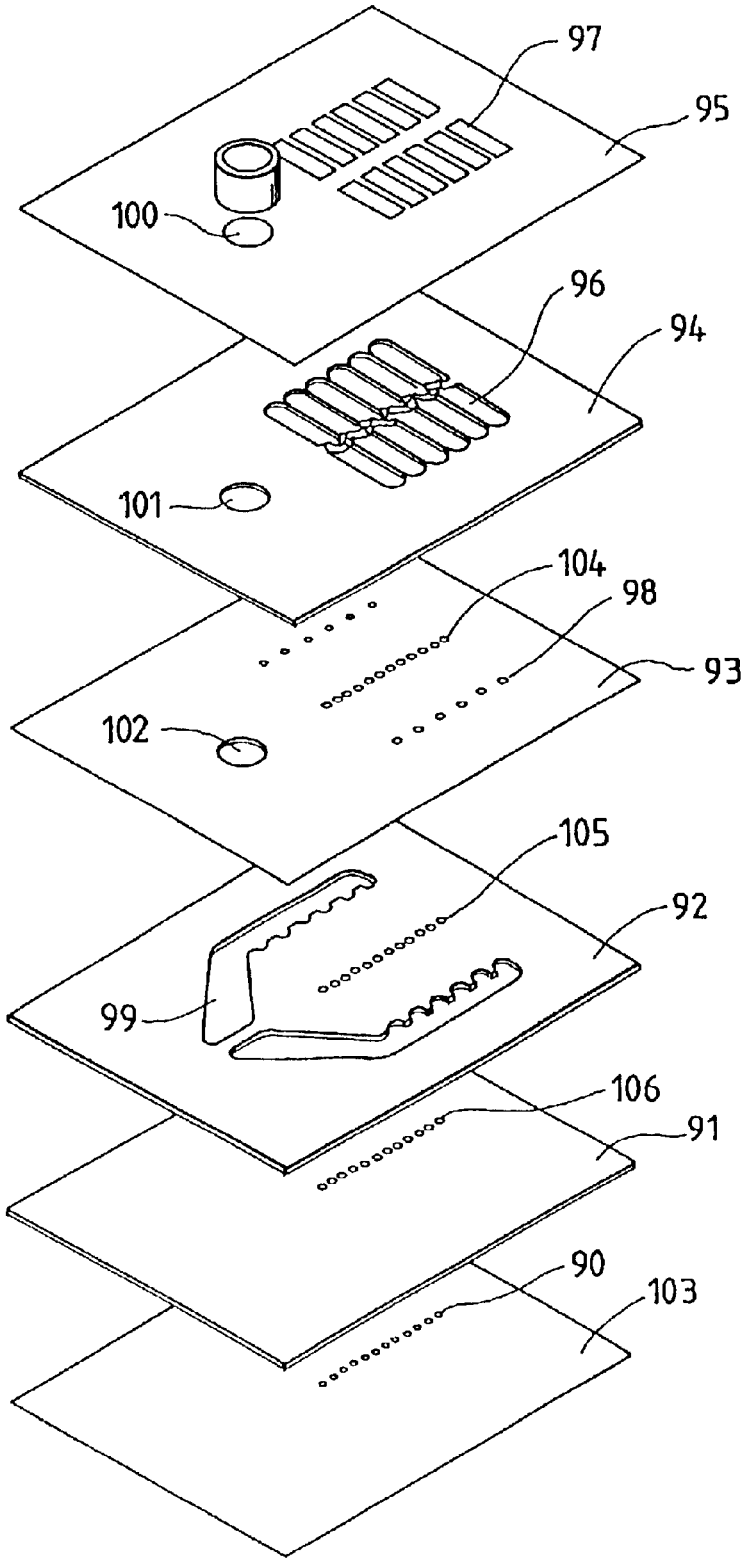
FIG. 13 PRIOR ART
FIG. 13 is a diagram showing an exemplary conventional laminated ink jet recording head.

FIG. 12 shows an embodiment in which an ink jet recording head having a high dot density is formed by using a plurality of actuator units 30*a*, 30*b*, 30*c*. In this embodiment, nozzles are pitched at an interval of 6 p in each of two arrays that belong to each of the actuator units 30*a*, 30*b*, 30*c*, and these nozzles in each array are staggered by p in the auxiliary scanning direction B. Since the pressure producing chambers in the two corresponding arrays are staggered by 3 p in the auxiliary scanning direction B, each nozzle is arranged toward one side with respect to the central axis of the corresponding pressure producing chamber.

Since the three actuator units 30*a*, 30*b*, 30*c* are staggered with respect to the corresponding nozzle arrays by 2 p, the nozzles are pitched at an interval of p when viewed in the main scanning direction A. That is, using the pressure producing chambers 5 pitched at an interval of 6 p, dots are formed at a density six times the interval.

As described above, the invention, which is characterized as mounting a plurality of actuator units on the single common flow path unit 60, can provide a recording head accommodating diverse uses only by changing the positions at which the actuator units of the same design are fixed to the single flow path unit.

Further, since the actuator units are mounted on the single flow path unit 60 so as to be scattered around, not only heat produced by the piezoelectric vibration elements can be quickly radiated, but also the positioning and dimensional accuracy of each nozzle can be regulated by the flow path unit made of metal or the like that can form through holes with relatively high accuracy. In addition, the actuator units that become hard to sinter as the size thereof is increased can be downsized.

As described in the foregoing, the invention is characterized as fixing a flow path unit to a plurality of actuator units so as to correspond to groups of nozzles; i.e., the flow path unit is formed by laminating a nozzle plate, a reservoir chamber forming board, and a seal board, the nozzle plate having nozzles divided into a plurality of groups, the reservoir chamber forming board having a plurality of reservoir chambers belonging to the respective groups of nozzles and having communicating holes respectively communicating with the nozzles, and the ink supply inlot forming board being fixed to a surface of the reservoir chamber forming board and having communicating holes for communicating with pressure producing chambers and nozzles; and each actuator unit including a pressure producing chamber forming board, a vibration plate, and piezoelectric vibration elements, the pressure producing chamber forming board having a plurality of pressure producing chambers defined by side walls, the vibration plate being fixed to a surface of the pressure producing chamber forming board, and the piezoelectric vibration elements being formed on a surface of the vibration plate so as to correspond to the pressure producing chambers. Therefore, the flow path unit serving also as the actuator unit fixing board can be made of metal that is comparatively easy to ensure proper accuracy by pressure working or the like, which not only allows nozzles with high positioning accuracy to be formed, but also contributes to downsizing the actuator unit made of ceramic that can be fixed by sintering and therefore improving yield of fabrication. In addition, even if a plurality of actuator units of the same design are used, a recording head adapted for various uses only by changing the structure of a flow path unit whoso design can be modified relatively easily can be provided.

What is claimed is:

1. An ink jet head comprising:

an actuator unit including a plurality of pressure producing chambers and pressure generating elements for generating a pressure change in the pressure producing chambers; and a flow path unit including a reservoir chamber for supplying ink to said pressure producing chambers, each one of said pressure producing chambers being communicated with said reservoir chamber and with a nozzle for jetting ink, wherein a plurality of actuator units are secured to a single flow path unit, said single flow path unit having a plurality of reservoir chambers, each one of said reservoir chambers corresponding to a respective one of said plurality of actuator units, and further wherein said flow path unit is larger in area than said plurality of actuator units.

2. An ink jet head comprising:

a flow path unit including a plurality of reservoir chambers; and a plurality of actuator units secured to said flow path unit, each one of said reservoir chambers corresponds to a respective one of said plurality of actuator units, wherein each of said plurality of actuator units comprises a plurality of pressure producing chambers and a plurality of pressure generating elements for generating pressure change in corresponding ones of the pressure producing chambers, wherein for each one of said plurality of actuator units, at least two pressure producing chambers are communicated with one of said plurality of reservoir chambers, and with nozzles for jetting ink, and further wherein said flow path unit is larger in area than said plurality of actuator units.

3. An ink jet head comprising:

a flow path unit including a plurality of reservoir chambers; and a plurality of actuator units secured to said flow path unit, wherein the plurality of said reservoir chambers are in communication with said plurality of actuator units, wherein each of said plurality of actuator units comprises a plurality of pressure producing chambers and a plurality of pressure generating elements for generating pressure change in corresponding ones of the pressure producing chambers, wherein for at least one of said plurality of actuator units one of said plurality of pressure producing chambers of said at least one of said plurality of actuator units is communicated with one of said plurality of reservoir chambers and a nozzle for jetting ink, a second one of said plurality of pressure producing chambers of said at least one of said plurality of actuator units is communicated with a second one of said plurality of reservoir chambers and a second nozzle for jetting ink, and further wherein said flow path unit is larger in area than said plurality of actuator units.

* * * * *